United States Patent [19]

Johnston

[11] 4,074,928

[45] Feb. 21, 1978

[54] ELECTRICAL CONNECTOR HAVING RELEASABLY RETAINED LATCH TAB ASSEMBLY

[75] Inventor: James J. Johnston, Old Saybrook, Conn.

[73] Assignee: Automatic Equipment Development Corporation, West Haven, Conn.

[21] Appl. No.: 749,088

[22] Filed: Dec. 9, 1976

[51] Int. Cl.[2] ..... H01R 13/54

[52] U.S. Cl. ..... 339/91 R; 339/176 S

[58] Field of Search ..... 339/91 R, 99 R, 176 R, 339/176 S

[56] References Cited

U.S. PATENT DOCUMENTS

| | | | |
|---|---|---|---|
| 3,289,145 | 11/1966 | Ruehlemann et al. | 339/91 R X |
| 3,369,214 | 2/1968 | Krumreich et al. | 339/91 R X |
| 3,699,498 | 10/1972 | Hardesty et al. | 339/99 R X |

*Primary Examiner*—Roy Lake
*Assistant Examiner*—E. F. Desmond
*Attorney, Agent, or Firm*—McCormick, Paulding & Huber

[57] ABSTRACT

A plug connector for a telephone cord set has a releasably retained resilient latch tab assembly for releasably securing the plug connector in coupled engagement within an associated jack in a part of a telephone. The latch tab assembly includes a pair of parallel mounting posts, received in holes in the body of the connector, and a resilient latch tab, integrally connected at one end to the mounting posts for flexure about an axis of flexure extending transversally of the posts. A latch tab assembly in accordance with the invention may be used to replace a broken latch tab which comprises an integral part of a plug connection.

13 Claims, 6 Drawing Figures

FIG. 1
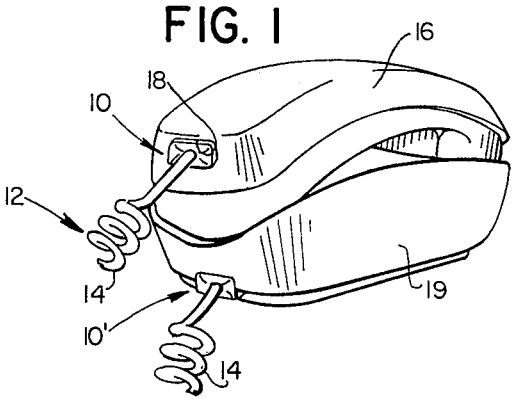
FIG. 6
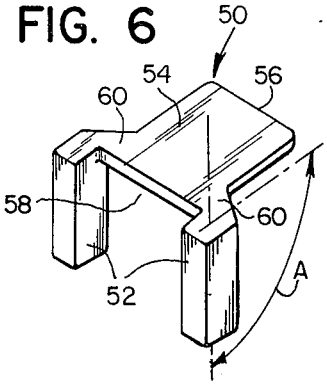
PRIOR ART
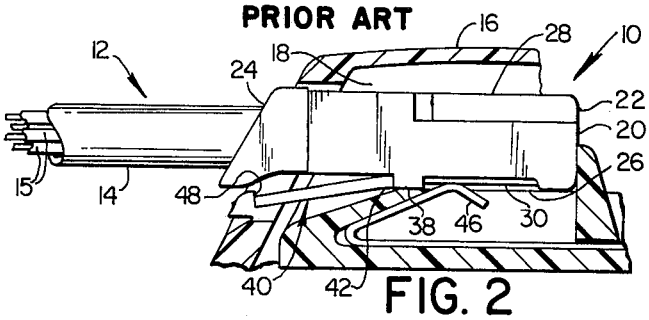
FIG. 2
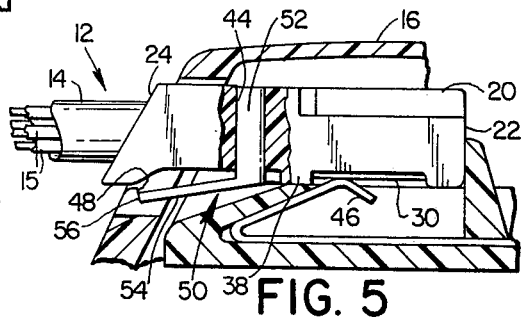
FIG. 5
PRIOR ART
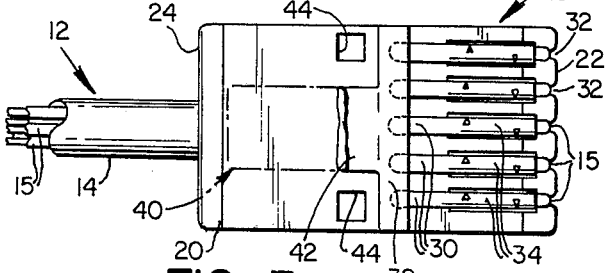
FIG. 3
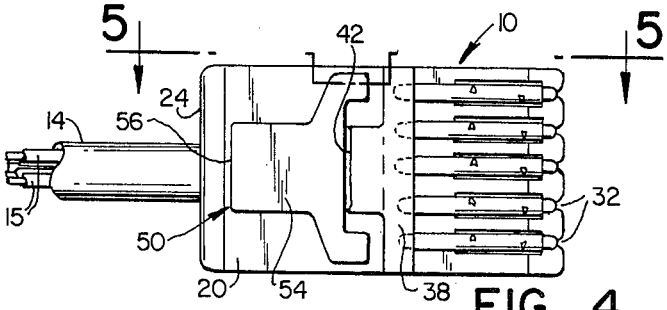
FIG. 4

ELECTRICAL CONNECTOR HAVING RELEASABLY RETAINED LATCH TAB ASSEMBLY

BACKGROUND OF THE INVENTION

This invention relates in general to electrical connectors and deals more particularly with an improved plug connector of the type which includes latching means for releasably securing the connector in coupled engagement with a receptacle or socket in which it is received. The plug device of the present invention is particularly suitable for use with telephone equipment.

In the telecommunication industry the increasing cost of repairing or replacing broken or worn equipment has resulted in the development of modular telephone hardware which may be added to existing telephone sets or built into new ones. Sicne telephone malfunctions occur most often in the cords, an arrangement which facilitates rapid, convenient cord replacement permits almost instant repair in many instances. In the modular cord sets used in such installations modularity is achieved through use of at least one miniaturized plug connector. Such a plug connector is provided with some form of integral latching tab which releasably retains the cord set in coupled engagement with a jack provided within the telephone instrument. If the integral latching tab is broken or damaged it is generally necessary to replace the entire cord set eventhough it may be otherwise serviceable. Some saving may be realized by salvaging or refurbishing the defective cord set by replacing the broken plug connector. However, it will now be evident that considerable further saving may be realized if repair or replacement of an entire modular cord set may be avoided, where the defect resides in the latch means employed to secure the cord set in connected relation to the telephone instrument. The present invention is primarily concerned with the aforedescribed general problem.

SUMMARY OF THE INVENTION

In accordance with the present invention an improved electrical connector is provided which includes a releasably retained latch tab assembly for securing the connector in coupled plugging relation within an associated receptacle or jack. In accordance with the present invention an improved latch tab assembly is provided which may be utilized to replace a broken latch tab on a plug connector of the type having an integral latch tab.

BRIEF DESCRIPTION OF THE DRAWING

FIG. 1 is a perspective view of a telephone set provided with a modular cord set having plug connectors embodying the present invention and inserted into jacks in the handset and base portion of the instrument.

FIG. 2 is a fragmentary elevational view of a typical plug device of the prior art having an integral latch tab and shown in connected relation with a jack in a telephone handset, the handset portion being shown in section.

FIG. 3 is a bottom view of the prior art device of FIG. 2 shown with a portion of the latch tab broken therefrom, the broken portion being shown in phantom.

FIG. 4 is similar to FIG. 3 but shows the plug device of FIG. 3 having a latch tab assembly embodying the present invention assembled therewith.

FIG. 5 is a sectional view taken generally along the line 5—5 of FIG. 4.

FIG. 6 is a perspective view of a latch tab assembly embodying the present invention.

DETAILED DESCRIPTION OF PREFERRED EMBODIMENT

The latch tab assembly of the present invention is particularly adapted to replace a broken or damaged latching tab on a plug connector of the type used on a modular cord set for a telephone or the like and is hereinafter described with reference to such a plug connector. Referring now to the drawing and considering first FIGS. 1–3, which illustrate prior art, a typical plug connector indicated generally by the reference numeral 10 comprises a part of a modular cord set for a telephone and indicated generally by the reference numeral 12. Cord set 12 includes a rectractile cord 14 which has an outer jacket of insulation and contains a plurality of individual insulated conductors. The plug 10 is connected to one end of the cord 14. A similar plug connector 10' is connected to the opposite end of the cord. In FIG. 1 the cord set 12 is shown attached to a conventional telephone which includes a handset 16. The handset has a jack 18 in which the plug connector 10 is received. The illustrated telephone further includes a base 19 which has another jack which receives the connector 10'. Each plug connector is releasably retained in its respectively associated jack by an integral locking tab, as will be hereinafter further described.

Considering the plug connector 10 in further detail and referring now particularly to FIGS. 2 and 3, it has a rigid generally rectangular body 20 which is preferably molded from suitable dielectric material using conventional injection molding-techniques. The rigid dielectric body 20 has a free or plugging end 22, a conductor-input end 24, a terminal supporting side 26 and a conductor guiding side indicated at 28. A cavity (not shown) is formed as a depression into the conductor guiding-side 28 and communicates with a conductor input aperture at the conductor-input end 24. The body 20 is formed with various other depressions and slots to accommodate the cord 14 and its individual conductors, however, an understanding of the manner in which these depressions and slots are formed is not essential to complete understanding of the present invention. Further, the manner in which the line cord 14 is arranged within the body 20 need not be considered in detail. It will suffice to note that the body is formed with a plurality of parallel terminal orienting grooves 30, 30 which open through the terminal-supporting side 26 and extend from the plugging end 22 and in the direction of the conductor-input end 24. Each terminal orienting groove 30 communicates with a conductor receiving groove 32 at the plugging end 22. A plurality of electrical terminals 34, 34 are secured by suitable means within the terminal orienting grooves 30, 30, each terminal being connected to an associated electrical conductor. An integral molded ridge projection designated generally by the numeral 38 extends transversely across the entire width of the body 20 on the terminal supporting side 26.

Formed integrally with the body is a resilient latching tab designated generally by the numeral 40. The tab is molded so that its longitudinally axis is oriented at an angle of approximately 15° with respect to the plane of the terminal supporting side 26. A hinge end 42 of the latching tab 40 is molded into one side of the bridge projection 38 at the central portion of the projection. The combined height of the bridge projection 38, thickness of the latching tab 40, and resilience of the latching tab, are such that the tab can be deflected inwardly of the body to a substantially coplanar position with respect to the outermost surface of the bridge projection 38. After release, the latching tab 40 will normally resume its original molded shape and orientation, because of its natural resilience.

Further referring to FIGS. 2 and 3, apertures 44, 44 extend through the body 20 from the conductor guiding side 28 to the terminal supporting side 26 and cooperate with various depressions and recesses formed in the conductor guiding portion of the body, but not shown, to provide a substantially uniform wall thickness for the molded part. The apertures 44, 44 are useful for mounting the body in an assembly fixture (not shown), when the terminals 34, 34 are assembled therewith.

Further referring to FIG. 2, the interrelationship between the plug connector 10 and the handset 16 is shown. When the plug connector is positioned in the jack defined by the handset, as shown in FIG. 2, each terminal 30 engages an associated contact spring 46 carried by the handset. The free end of the latching tab 40 snaps behind a ridge 48 on the handset 16 to releasably retain the plug connector 10 within the associated jack in the handset with each terminal 30 in contact engagement with an associated contact spring contact 46 therein. Thus, the latching tab 40 serves to releasably retain the plug connector 10 in electrically connected engagement with the handset 16. The latching tab 40 may be released by inserting an appropriate tool into the handset to deflect the tab inwardly toward the terminal supporting surface 26 and out of engagement with the ridge 48. A plug connector of the type hereinbefore described is further illustrated and described in U.S. Pat. No. 3,617,982 to Hardesty, issued Nov. 2, 1971, and for a more detailed disclosure of a typical plug connector of the type with which this invention is concerned reference may be had to the forementioned U.S. patent.

A latching tab such as the tab 40 may become broken or damaged in use, so that the plug connector can no longer be properly maintained within an associated receptacle or jack. In FIG. 3 the plug 10 is shown with a portion of its latching tab 40 broken therefrom at its hinge end 42 and generally along its hinge axis of flexure, the unbroken condition of the latching tab 40 being indicated by broken lines.

Referring now to FIG. 6 a repair clip or latch tab assembly for replacing the broken latching tab 40 and embodying the invention is indicated generally by the numeral 50. The tab assembly 50 comprises a unitary structure which is preferably molded from a resilient plastic material and includes a pair of substantially parallel mounting posts 52, 52 and a retaining tab 54 integrally connected at one end to each of the mounting posts and having a free end 56 longitudinally spaced from its connected end. The longitudinal axis of the retaining tab preferably forms an obtuse included angle A of approximately 105° with a plane containing the axes of the mounting posts 52, 52. Preferably, and as shown, the tab 54 is formed with a recess 58 intermediate the two mounting posts. The posts 52, 52 are adpated to be slidably received in the aperture 44, 44 and are preferably transversely spaced apart a distance substantially equal to the transverse spacing between the apertures. However, the spacing between the mounting posts relative to the spacing between the mounting apertures may be such that each post frictionally engages a side wall of an associated aperture when the latch tab assembly 50 is assembled therein. In the illustrated embodiment, each mounting post 52 has a substantially square cross section which generally complements the cross section of an associated aperture 44. The retaining tab 54 has a substantially narrower width than the spacing distance between the posts 52, 52 so that each post is connected to the mounting tab 54 by a relatively narrow connecting portion 60.

In repairing a plug connector 10, which has a broken or damaged latching tab 40, any remaining portion of the broken latching tab is preferably broken or cut away at its hinge end 42 and generally along its axis of flexure, that is the point at which it is hingedly connected to the body 20. Thereafter, a latch tab assembly 50 is assembled with the plug connector by inserting each mounting post 52 in an associated aperture 44 from the terminal supporting side 26 with the retaining tab 54 extending in the direction of the conductor-input end 24. Light pressure is then applied to the tab assembly 50 to fully seat it within the apertures 44, 44. In its assembled condition the retaining tab 54 is inclined outwardly from the terminal supporting side 26 at an angle of approximately 15 degrees. The plug connector with the latch tab assembly 50 releasably secured thereto may now be inserted into a jack in a conventional manner to be releasably retained therein by the tab assembly. The plug connector may be released from the jack by deflecting the retaining tab 54 inwardly toward the terminal support surface 26 using a suitable tool as hereinbefore described. If the tab assembly 50 should become damaged or broken it may be removed from its associated plug connector by simply pushing the mounting posts 52, 52 out of the mounting apertures in the plug connector. Any suitable implement available may be used to push out the mounting posts. The broken or damaged latch tab assembly may then be replaced by another tab assembly of like kind.

The present invention has been illustrated and described with reference to a latch tab assembly particularly adapted for use in repairing a damaged plug connector of the type which has a resilient latching tab integrally molded as a part of the connector body. However, the present invention may also be practiced with releasably retained plug connectors of other types. A plug connector of a type which has a molded plug body and a resilient spring metal latch or detent tab riveted thereto is in widespread use in the telecommunication industry and is found on molular cord sets of the general type hereinbefore described. A plug connector which has such a spring latch tab and is illustrated and described in U.S. Pat. No. 3,369,214 to Krumreich et al., issued Feb. 13, 1968, and reference may be had to the Krumreich patent for disclosure of such a plug connector. It will be readily apparent to those skilled in the art that a latch tab assembly embodying the present invention may be used as a replacement for a damaged or broken spring metal tab on a plug connector of the type illustrated and described in the patent to Krumreich et al., by the simple expedient of removing the spring metal tab and the rivets which retain it to thereby expose rivet holes which open through a body surface associated with the tab. The rivet holes may then accommodate the mounting posts on a latch tab assembly such as aforedescribed. The rivet apertures may be enlarged to accommodate the mounting posts, if required. It will be further apparent to those skilled in the art that the latch tab assembly of the present invention may comprise a part of a plug connector in its original manufactured form and such a combination is contemplated within the scope of the invention.

I claim:

1. A latch tab assembly for replacing a broken latching tab on a plug device of a type which cooperates in plugging relation with a receptacle to electrically connect an elongated flexible conductor attached to the plug device with an internal contacting component within the receptacle, the plug device having a body including a plugging end, the latching tab in its undamaged condition being connected at one end to the body adjacent an associated surface thereof and extending outwardly therefrom in inclined relation to the associated surface and in a direction away from said plugging end for releasably retaining the body in the receptacle, the body having a pair axially parallel and transversely spaced apart holes opening through the associated surface, said latch tab assembly comprising a unitary structure made from resilient plastic material and including a pair of generally parallel mounting posts for respective positioning in the holes, and a retaining tab integrally connected at one end to each of said mounting posts for flexure about an axis of flexure extending generally transversely of said posts, said retaining tab having a free end opposite said one end and extending generally longitudinally outwardly from the associated surface in inclined relation thereto and in a direction of away from the plugging end when said mounting posts are positioned in the holes to retain the latch tab assembly in assembled relation with the plug device.

2. A latch tab assembly as set forth in claim 1 wherein said latch tab assembly is made from resilient dielectric plastic material.

3. A latch tab assembly as set forth in claim 1 wherein said retaining tab has a recess intermediate said mounting posts and opening in a direction opposite the direction of the plugging end for providing clearance for a remaining portion of the damaged latching tab when said latch tab assembly is assembled with the plug device.

4. A latch tab assembly as set forth in claim 1 wherein said retaining tab is inclined at an angle of appoximately 15° relative to the associated surface.

5. A latch tab assembly as set forth in claim 1 wherein the distance between said mounting posts is substantially greater than the transverse width of said retaining tab and said retaining tab is connected to each of said mounting posts by a relatively narrow connecting portion.

6.A latch tab assembly as set forth in claim 5 wherein said retaining tab has a recess therein intermediate said mounting posts and opening in a direction opposite the direction of said plugging end.

7. The combination comprising a plug device for co-operating with a receptacle to electrically connect an elongated flexible conductor attached to said plug device to an internal contacting component within the receptacle, and a latch tab assembly releasably secured in assembly with said plug device for releasably retaining said plug device within the receptacle, said plug device having a body including a plugging end and having a pair of transversely spaced holes longitudinally spaced from said plugging end and opening through an associated surface of said body, said latch tab assembly comprising a unitary structure including a pair of parallel mounting posts, each of said posts received in an associated one of said holes, said latch tab assembly including a retaining tab having a secured end and an abutment surface at its opposite end, said retaining tab being integrally connected to said mounting posts at said secured end for pivotal movement about an axis of flexure extending transversely of said body, said locking tab being inclined outwardly away from said associated surface and in the direction of said plugging end.

8. A latch tab assembly as set forth in claim 7 wherein said retaining tab is inclined outwardly from said associated surface at an angle of approximately 15°.

9. A latch tab assembly for a plug device of a type which cooperates in plugging relation with a receptacle, said latch tab assembly comprising a unitary structure made from resilient plastic material and including a pair of substantially straight axially elongated mounting posts supported in axially parallel relation to each other for respective slidably positioning within a pair of holes in the plug device in frictional engagement with the plug device, each of said mounting posts having a substantially uniform cross section throughout its length, and an elongated retaining tab integrally connected at one end to an associated end of each of said mounting posts for flexure about an axis of flexure extending generally transversely of said mounting posts, said retaining tab having a substantially uniform thickness and a free end longitudinally opposite said one end, the longitudinal axis of said retaining tab forming an obtuse included angle with a plane containing the axes of said mounting posts.

10. A latch tab assembly as set forth in claim 9 wherein said longitudinal axis forms an included angle of approximately 105° with said plane.

11. A latch tab assembly as set forth in claim 9 wherein said retaining tab has a recess therein intermediate said mounting posts and opening in a direction opposite the direction of extent of said retaining tab.

12. A latch tab as set forth in claim 11 wherein the spacing between said mounting posts is greater than the width of said retaining tab.

13. A latch tab assembly as set forth in claim 12 wherein each of said mounting posts is connected to said retaining tab by an associated relatively narrow connecting portion of said retaining tab.

* * * * *